United States Patent [19]

Laird

[11] 4,395,071

[45] Jul. 26, 1983

[54] FURNITURE WITH REMOVABLE CUSHIONS

[76] Inventor: William B. Laird, 861 E. Market St., Marietta, Pa. 17547

[21] Appl. No.: 237,338

[22] Filed: Feb. 23, 1981

[51] Int. Cl.[3] ..... A47C 4/02

[52] U.S. Cl. ..... 297/440; 297/443; 297/455

[58] Field of Search ..... 297/440, 455, 68, 442, 297/443; 296/57 R; D6/62

[56] References Cited

U.S. PATENT DOCUMENTS

| | | | |
|---|---|---|---|
| D. 263,656 | 4/1982 | Williams | D6/62 |
| 3,146,021 | 8/1964 | Ericson | 296/57 R X |
| 3,972,565 | 8/1976 | Smith | 297/455 |
| 3,989,300 | 11/1976 | Heumann | 297/440 |
| 4,285,544 | 8/1981 | Zapf | 297/440 |

FOREIGN PATENT DOCUMENTS

| | | | |
|---|---|---|---|
| 1283660 | of 1962 | France | 297/442 |

*Primary Examiner*—James T. McCall
*Assistant Examiner*—David L. Talbott
*Attorney, Agent, or Firm*—Seidel, Gonda, Goldhammer & Panitch

[57] ABSTRACT

Furnitrue in the form or a chair, love seat or couch is provided with a frame having at least one removable cushion. The cushion has oppositely disposed grooves. Each groove is adapted to receive a tongue on a frame. A latch mechanism is provided within the cushion for cooperating with mating structure on an associated tongue whereby the cushion may be removed and replaced by another similar cushion or may merely be flipped over and replaced.

10 Claims, 8 Drawing Figures

FIG. 1
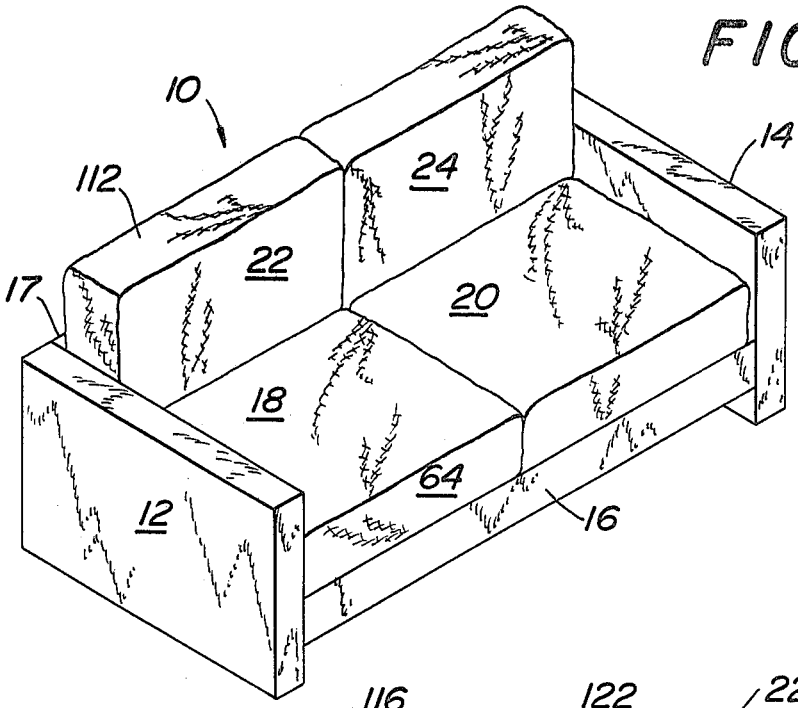
FIG. 6
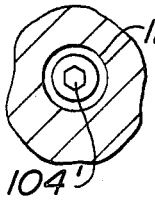
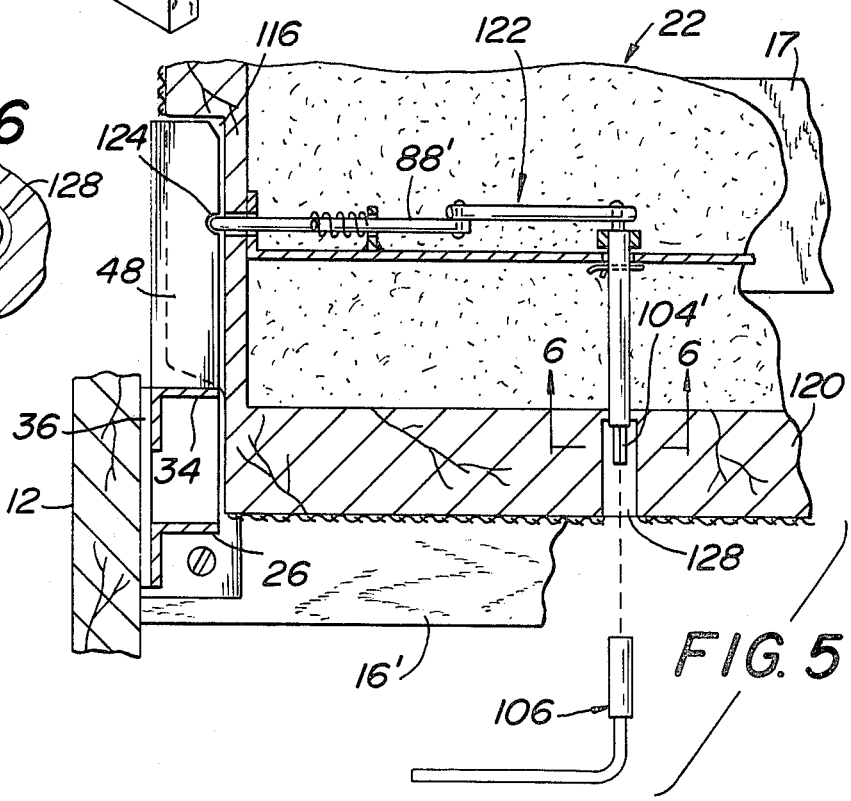
FIG. 5

16'
7
4
52
40
56
70
38
30
90
18
22
98
62
58
60
100
72
96
74
122
88
26
34
68
48
12

17
30
52
120
40
38
118
90'
122
5
22
18
88
116
12

FURNITURE WITH REMOVABLE CUSHIONS

BACKGROUND OF THE INVENTION

A conventional chair has a seat cushion and a back cushion. A love seat has two seat cushions and two back cushions. A couch has three seat cushions and three back cushions. There is a need for furniture of that type wherein the cushions are adapted to be removed, flipped over, and replaced while being latched to the furniture frame in a manner so that only authorized persons may remove the cushions. The present invention is directed to a solution to that need.

SUMMARY OF THE INVENTION

The present invention is directed to furniture of the chair, love seat and or couch type. The furniture includes a frame having at least one removable cushion. The cushion has oppositely disposed grooves. A pair of tongues is provided on the frame. Each tongue projects into one of the grooves. A latch menas is provided within the cushion. The latch means includes a latch member projecting into each one of the grooves on the cushion for latching cooperation with mating structure on the associated tongue. An actuator is provided on the cushion remote from the latch members for releasing the latch member so that the cushion may be removed.

The present invention also includes as an article of manufacture, a furniture cushion per se. The cushion includes a padded framework having an outer covering. Exposed grooves are provided on opposite sides of the opposite sides of the framework. A latch means is supported within the cushion. The latch means includes a latch member partially exposed in each groove for latching the cushion to a frame.

It is an object of the present invention to provide furniture having cushions which are removable and or replaceable by way of a tool in the possession of authorized personnel.

It is another object of the present invention to provide furniture with removable cushions by way of a concealed latch means requiring a special tool to facilitate unlatching the cushions from a frame.

It is another object of the present invention to provide a novel article of manufacture in the form of a removeable replaceable furniture cushion.

Other objects and advantages will appear hereinafter.

For the purpose of illustrating the invention, there is provided in the drawing a form which is presently preferred; it being understood, however, that this invention is not limited to the precise arrangements and instrumentalities shown.

FIG. 1 is a perspective view of one type of furniture in accordance with the present invention.

FIG. 5 is a sectional view taken along the line 5—5 in FIG. 4.

FIG. 6 is a sectional view taken along the line 6—6 in FIG. 5.

DETAILED DESCRIPTION OF THE INVENTION

Figure 2:
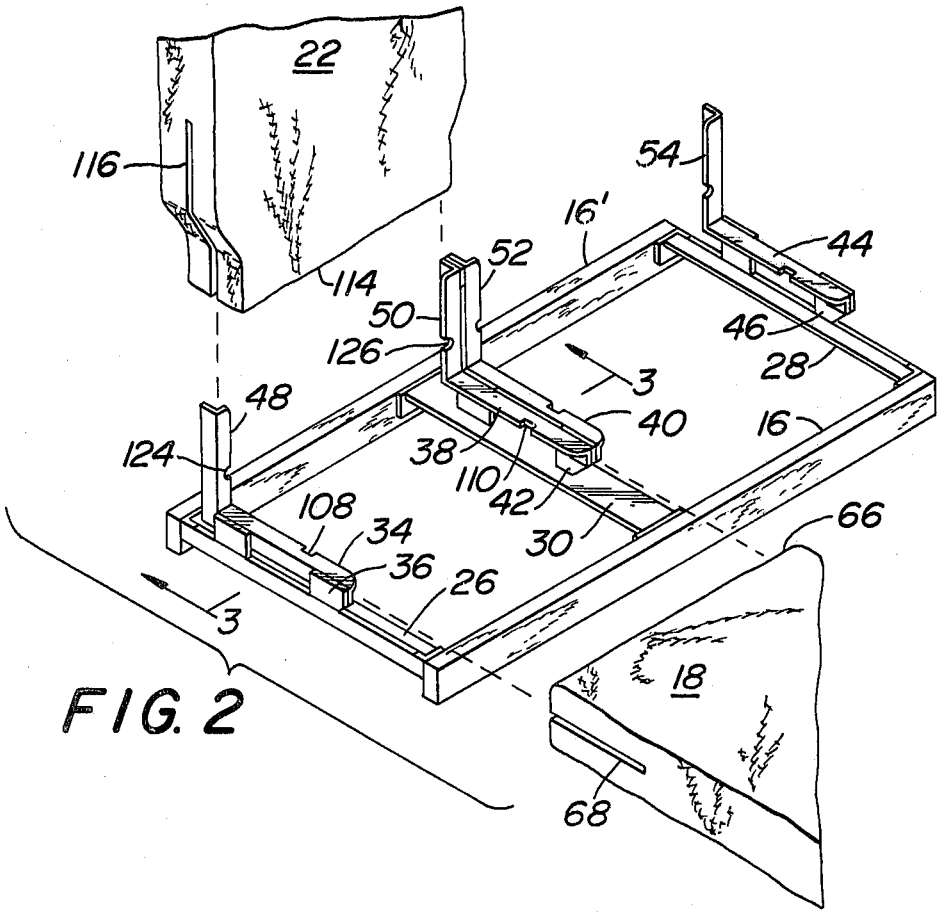
FIG. 2 is an exploded view of a frame and a pair of cushions forming part of the invention.

Referring to the drawing in detail, wherein like numerals indicate like elements, there is shown in FIG. 1 one form of furniture in accordance with the present invention. The furniture 10 is in the form of a love seat having frame ends 12 and 14 with horizontally disposed front and rear frame members 16, 16'. A rear cushion brace 17 extends between the frame ends 12 and 14. The frame ends 12 and 14 may assume a wide variety of shapes and materials. As disclosed herein, the frame ends 12 and 14 and the frame members 16, 16' and brace 17 are made of wood.

The furniture 10 includes a pair of seat cushions 18 and 20 which are generally horizontally disposed and a pair of back cushions 22, 24 which are generally vertically disposed. Referring to FIG. 2, there is shown a frame portion which can be preformed for attachment to the frame ends 12 and 14. The frame members 16 and 16' are horizontally interconnected by end rails 26, 28 and center rail 30. Each of the rails is preferably an angle iron with mounting plates on their ends for attachment to the front frame member 16 and the rear frame member 16'.

A horizontally disposed tongue 34 is supported from the rail 26 by a spacer 36. Tongue 34 may conveniently be one of the flanges of an angle iron. A pair of center tongues 38, 40 are supported from the center rail 30 by spacers 42. The tongues 38, 40 likewise may be one of the flanges of an angle iron. A tongue 44 is supported from the rail 28 by a spacer 46. Tongue 44 may likewise be one of the flanges or an angle iron. All of the tongues 34, 38, 40, and 44 are horizontally disposed at the same elevation.

A vertically disposed tongue 48 is supported in any convenient manner such as by the tongue 34 adjacent to the rear frame member 16'. Vertically disposed tongues 50, 52 are supported in any convenient manner such as by the tongues 38, 40 respectively adjacent the rear frame member 16'. A vertically disposed tongue 54 is supported in any convenient manner such as by the tongue 44 adjacent the rear rail member 16'. The tongues 48, 50, 52 and 54 are aligned with one another.

Figure 3:
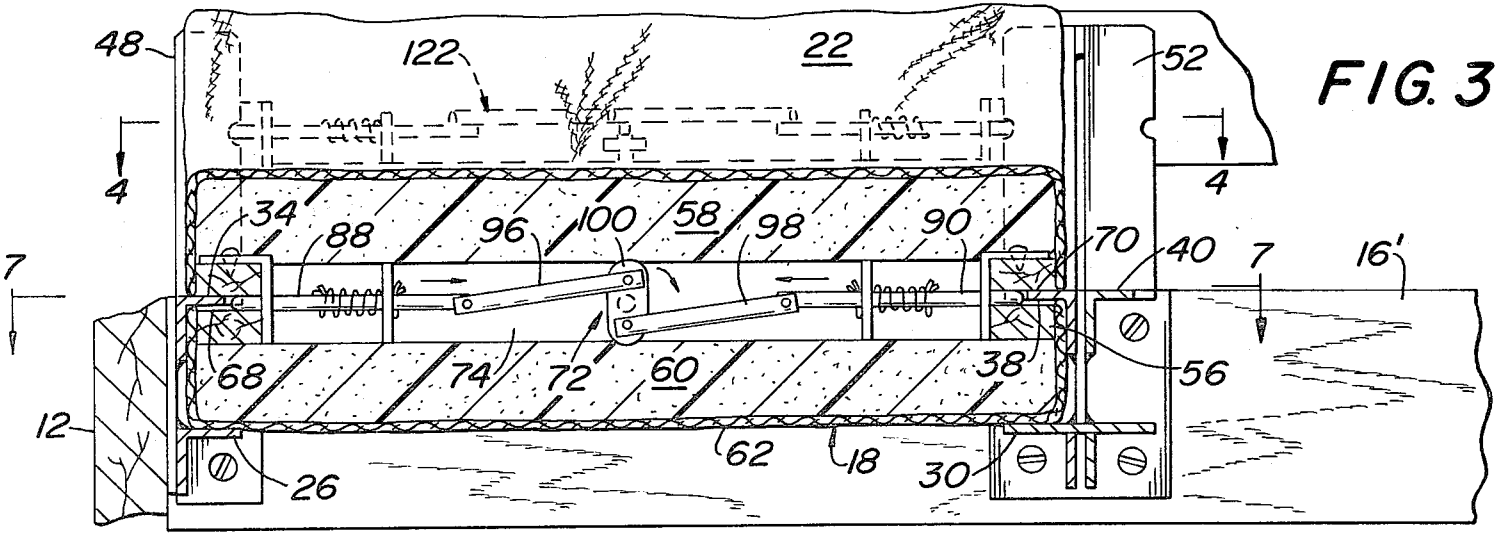
FIG. 3 is a sectional view taken along the line 3—3 in FIG. 2 with the cushions in place.

The cushion 18 and the cushion 20 are identical. Cushion 18 has a rectangular framework 56 therewithin. See FIGS. 3 and 7. The framework 56 is made from wood, plastic, or any other suitable rigid material. Framework 56 is rectangular and corresponds generally to the size of the cushion 18. As shown in FIG. 3, the framework 56 is centrally disposed so as to be between an upper foam cushion padding 58 and a lower foam cushion padding 60. The entire cushion 18 is enclosed within an outer removable covering 62 such as fabric.

The cushion 18 has a front end 64 and a rear end 66. See FIGS. 1, 2 and 7. Along one side, the cushion 18 is provided with a groove 68 which extends from the rear end 66. See FIG. 2. On the opposite side, the cushion 18 has a similar groove 70. The grooves 68 and 70 are exposed and are provided in the framework 56. Fabric covering 62 has portions joined to framework 56 along the grooves 68, 70. A selectively operable latch means 72 is provided within the cushion 18 generally equidistant from the major faces of the cushion.

Figure 8:
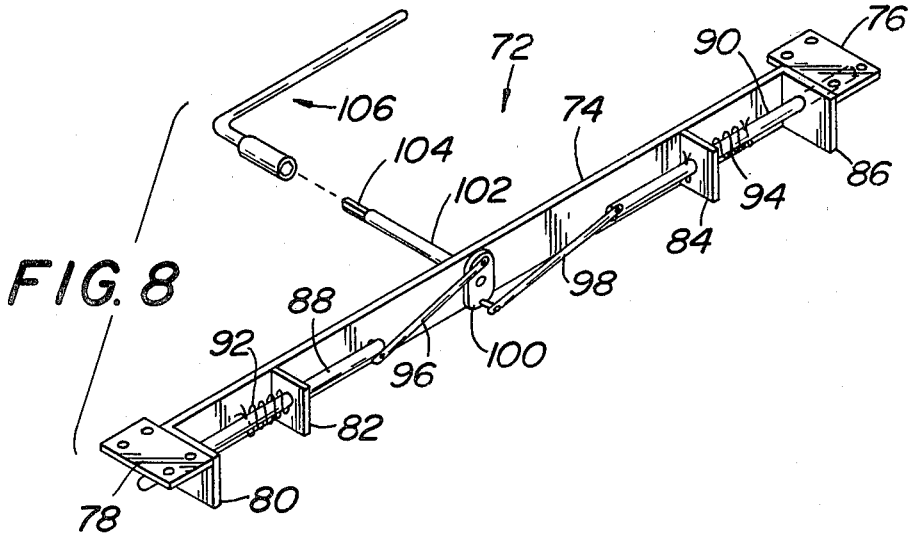
FIG. 8 is a perspective view of a latch means and an associated actuator tool.
Figure 7:
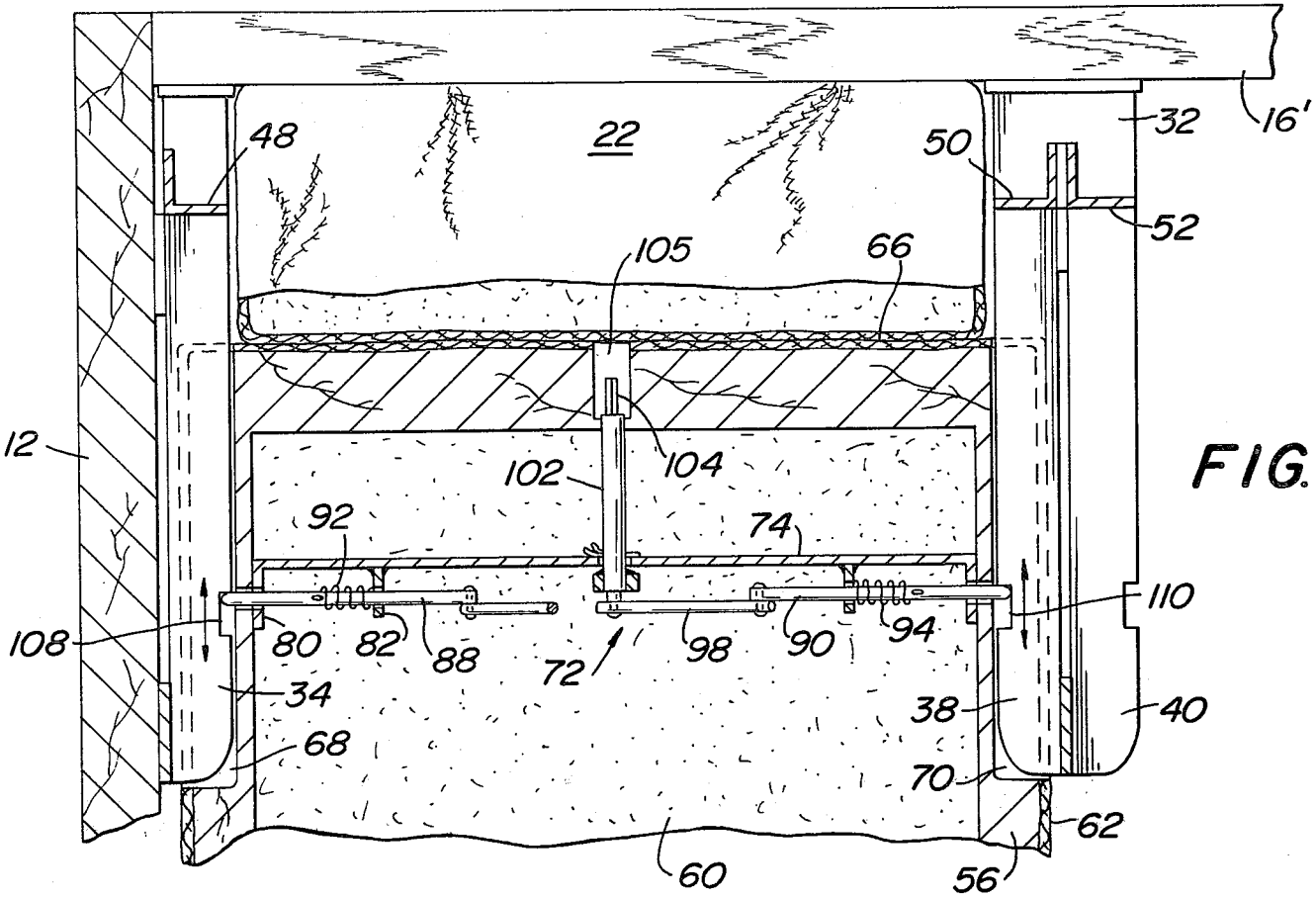
FIG. 7 is a sectional view taken along the line 7—7 in FIG. 3.

The latch means 72 is best shown in FIG. 8 but also appears in FIGS. 3 and 7. The latch means 72 includes a rigid metal mounting plate 74 having mounting brackets 76 and 78 at its ends. The width of plate 74 corresponds to the thickness of framework 56. The brackets 76, 78 facilitate fastening the latch means 72 to the upper surface on oppositely disposed side portions of the framework 56.

The plate 74 has a pair of spaced guides 80, 82 attached to a side face thereof adjacent one end and a similar pair of guides 84, 86 adjacent its other end. A latch member 88 is reciprocably supported by the guides 80, 82. A latch member 90 is reciprocably supported by the guides 84, 86. A coil spring surrounds member 88 and extends from guide 82 to a cotter pin or the equivalent so as to bias member 88 away from member 90. Member 90 is provided with a similar spring 94.

The inner most end of member 80 is pivotably connected to one end of a connecting rod 96. The inner most end of member 90 is pivotably connected to one end of a connecting rod 98. The other ends of the connecting rods 96, 98 are pivotably connected to opposite ends of a swivel plate 100 which is rotatably supported by the mounting plate 74. Swivel plate 100 has an integral actuating rod 102 which terminates in a specially shaped head 104 which can only be actuated by a mating actuating tool 106. As shown more clearly in FIG. 7, the head 104 is exposed within a recess 105 in the framework 56 adjacent the rear end 66 of the cushion 18. Recess 105 is concealed by the cushion 22.

As shown more clearly in FIG. 3, the latch member 88 extends into the groove 68 while latch member 90 extends into the groove 70. The tongue 34 is provided with mating structure such as notch 108 into which one end of the member 88 extends to thereby latch the cushion 18 to the frame of the furniture 10. The tongue 38 is provided with a similar mating structure such as notch 110 for receiving one end of the latch member 90. The latch members 88, 90 are spring biased outwardly away from each other by their respective springs 92, 94. The latch members 88, 90 may be selectively withdrawn into the interior of the framework 56 as shown in FIG. 3 by rotating the head 104 in a clockwise direction in FIG. 3 while using the tool 106.

Figure 4:
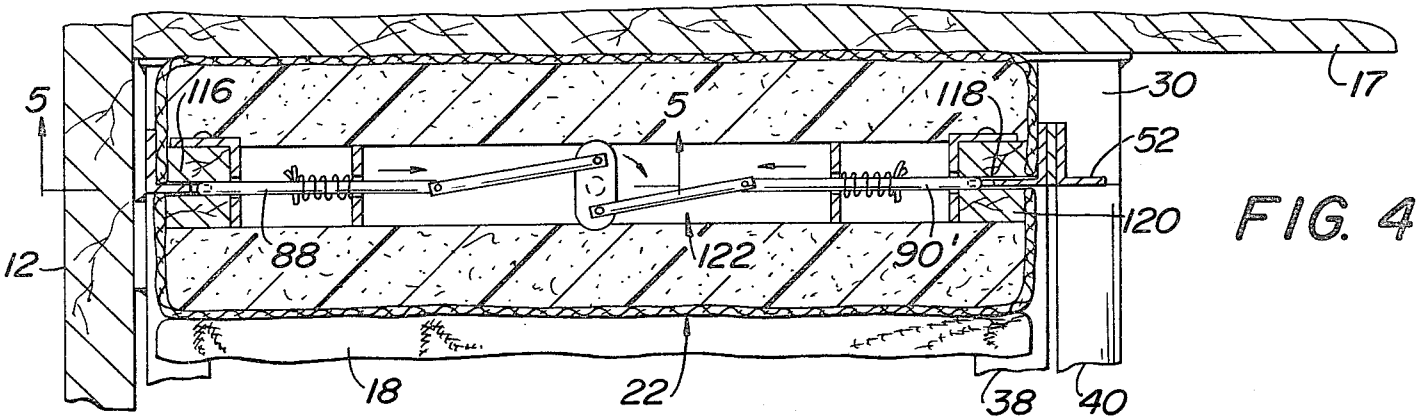
FIG. 4 is a sectional view taken along the line 4—4 in FIG. 3.

The cushion 22 has an upper end 112 and a lower end 114. As shown more clearly in FIG. 2, the lower end 114 is narrower than the upper end 112 so that the lower end may enter the space between the tongues 34, 38. Cushion 22 has a groove 116 on one side and a groove 118 on the opposite side. See FIG. 4.

A rectangular framework 120 is provided within the cushion 22 in the same manner as the framework 56 is provided within the cushion 18. Between the cushion paddings, the framework 120 is provided with a latch means 122. Latch means 122 is identical with latch means 72 and hence corresponding elements are provided with corresponding prime numerals. Latch member 88' is spring biased into the groove 116 for cooperating with mating structure such as the notch 124 on the tongue 48. Likewise, the latch member 90' extends into the groove 118 for cooperating with mating structure such as the notch 126 on the tongue 50. The framework 120 has a recess 128 into which extends the head 104' for actuation by the tool 106. To facilitate ease with which the tongues enter their respective grooves, the leading end of the tongues are beveled or curved as shown in FIG. 2.

If cushion 18 is soiled, torn, has a cigarette burn hole, etc. it may be readily removed, flipped over, and returned to the assembled portion as disclosed herein. Alternatively, cushion 18 may be completely removed and a substitute cushion 18 positioned in its place. The furniture 10 is particularly useful in lobbies of airports, school dormitories, or the like wherein they will receive substantial abuse. Only authorized personnel will have a tool such as tool 106 to facilitate removal of the cushions.

Cushion 20 is removably latched to the tongues 40, 44 in the same manner as cushion 18. Cushion 24 is removably latched to the tongues 52, 54 in the same manner as cushion 22. Hence, a detailed description of the latching of cushions 20, 24 is not deemed necessary.

As mentioned above, the furniture 10 may be a chair having a single seat cushion 18 and a single back cushion 22, may be a love seat having seat cushions and back cushions as illustrated and described above, or may be a couch having three seat cushions and three back cushions. A cushion per se such as cushion 18 may be sold separately as replacement cushions and as such constitutes an article of manufacture coming within the scope of the present invention. A prefabricated assembly as shown in FIG. 2 may be attached to any desired type of frame ends which need not be solid ends as illustrated at 12 and 14. Thus, the style of furniture may be varied as desired while still incorporating the present invention.

The notches 108, 110 are preferably elongated so as to facilitate horizontal shifting of the cushion 18 away from the cushion 22 for a sufficient distance so that a tool 106 may be inserted into the recess 105 for removal of cushion 18 and/or into recess 128 for removal of cushion 22. This will facilitate removal and replacement of cushion 18 without first removing cushion 22 and vice versa. If desired, the furniture 10 may be turned upside down for access to recess 128 and removal of cushion 22 without disturbing cushion 18.

The present invention may be embodied in other specific forms without departing from the spirit or essential attributes thereof and, accordingly, reference should be made to the appended claims, rather than to the foregoing specification, as indicating the scope of the invention.

I claim:

1. Furniture of the chair, love seat and couch type comprising a frame having at least one removable cushion, said cushion having oppositely disposed grooves, a pair of tongues on said frame, each tongue projecting into one of said grooves, latch means within said removable cushion, said latch means including a latch member projecting into at least one of the grooves on the cushion for latching cooperation with mating structure on the associated tongue, and an actuator on the cushion and connected to the latch member for releasing the latch member so that the cushion may be removed.

2. Furniture in accordance with claim 1 wherein said groove is shorter than the cushion and arranged so as to be visible only at the sides and one end of the cushion.

3. Furniture in accordance with claim 2 wherein said latch means includes a pair of latch members, each latch member extending into a separate one of said grooves, said actuator being connected to each latch member for simultaneously actuating the latch members.

4. Furniture in accordance with claim 1 wherein said frame has a pair of removable cushions, one of the removable cushions being a seat cushion and the other being a back cushion, each cushion being provided with a latch means therewithin, each cushion having a pair of oppositely disposed grooves for receiving a discrete tongue on the frame.

5. Furniture in accordance with claim 1 wherein said mating structure on said tongue is a notch into which said latch member projects.

6. Furniture in accordance with claim 1 wherein said cushion has a padded framework surrounded by an outer covering, said grooves being exposed on opposite sides of the framework, the padded framework having padding on opposite faces thereof with said latch means being disposed between the paddings.

7. Furniture comprising a frame having at least two removable cushions which are generally horizontally disposed and two removable back cushions which are generally vertically disposed, each seat cushion abutting one of the back cushions, each cushion having oppositely disposed grooves which are exposed and extend for a length shorter than the length of the cushions, a pair of tongues on said frame for each cushion, each tongue projecting into one of said grooves, latch means within each cushion, each latch means including a pair of latch members, each latch member projecting into a separate one of the grooves on its associated cushion for latching cooperation with mating structure on the associated tongue, and an actuator on each cushion remote from its associated latch members for releasing the associated latch members so that the cushions may be removed from the frame.

8. Furniture in accordance with claim 7 wherein each cushion has a rectangular framework therewithin, said grooves being disposed in said framework, each cushion including padding on opposite faces of the framework, each latch means being disposed between the paddig of its associated cushion so as to be generally in the same elevation as its framework generally equidistant from the major faces of the cushion.

9. An article of manufacture comprising a furniture cushion, said cushion having a framework with padding on opposite faces thereof and within an outer covering, said cushion having exposed grooves on opposite sides of the framework adjacent one end, a latch means supported within the cushion, said latch means including a discrete movable latch member partially exposed in each groove for latching the cushion to a frame.

10. An article in accordance with claim 9 wherein each latch member is reciprocably supported within its cushion and spring biased outwardly into its associated groove, and a common actuator coupled to each of the latch members for simultaneously releasing the latch members, said actuator being accessible along an end of the cushion which is generally perpendicular to said opposite sides containing said grooves.

* * * * *